US010633786B2

(12) United States Patent
Spencer

(10) Patent No.: US 10,633,786 B2
(45) Date of Patent: Apr. 28, 2020

(54) AERATOR

(71) Applicant: Timothy D. Spencer, Nampa, ID (US)

(72) Inventor: Timothy D. Spencer, Nampa, ID (US)

( * ) Notice: Subject to any disclaimer, the term of this patent is extended or adjusted under 35 U.S.C. 154(b) by 149 days.

(21) Appl. No.: 16/103,287

(22) Filed: Aug. 14, 2018

(65) Prior Publication Data

US 2019/0106834 A1 Apr. 11, 2019

Related U.S. Application Data

(60) Provisional application No. 62/570,711, filed on Oct. 11, 2017.

(51) Int. Cl.
*D06F 59/04* (2006.01)

(52) U.S. Cl.
CPC ..... *D06F 59/04* (2013.01)

(58) Field of Classification Search
CPC ..... F28F 1/24; F28F 1/26; F28F 1/28; F28F 1/30; B21D 53/04
See application file for complete search history.

(56) References Cited

U.S. PATENT DOCUMENTS 2,298,250 A * 10/1942 Brown, Jr. ..... B23K 11/0046 219/107
2,641,830 A * 6/1953 Lamb ..... B21C 37/104 228/150
3,477,622 A 11/1969 Appelt
3,764,774 A * 10/1973 Boose ..... B21C 37/26 219/62
3,831,675 A * 8/1974 McLain ..... B21C 37/0803 165/177
4,163,474 A * 8/1979 MacDonald ..... B21C 37/225 138/103
4,209,913 A 7/1980 Wallin et al.
4,604,993 A 8/1986 Moriwaki et al.
4,689,897 A 9/1987 Marsalona
4,991,756 A * 2/1991 Benjamin ..... D06F 59/04 223/72
5,115,580 A 5/1992 Blumenfeld et al.
5,117,565 A 6/1992 Willenbacher, Jr.
5,287,636 A 2/1994 Lafleur et al.
(Continued)

OTHER PUBLICATIONS

Implus LLC, Dryguy "Dry Rack": https://dryguy.com/product/Dry_Rack; Accessed Oct. 16, 2018.

(Continued)

*Primary Examiner* — David J Laux
(74) *Attorney, Agent, or Firm* — Shaver & Swanson, LLP; Scott D. Swanson

(57) ABSTRACT

What is disclosed is an aerator for use with clothing such as socks, gloves, shoes, and/or boots. In a preferred embodiment the aerator is provided as a flat stock that can be wrapped or rolled to form a spherical aerator. The aerator forms a cylindrical base with projections emanating from the cylinder. These projections generally span the length of the cylinder. In a preferred embodiment the projections are generally triangular in shape. In a further preferred embodiment the cylinder and/or projections utilize openings to enhance air flow. The aerator can be utilized in conjunction with a forced air system or can be used for passive aeration. What is further disclosed is the method of using an aerator for drying an article of clothing.

12 Claims, 8 Drawing Sheets

(56) References Cited

U.S. PATENT DOCUMENTS

| | | | | |
|---|---|---|---|---|
| 7,716,849 | B1 | 5/2010 | Hicks | |
| 8,739,432 | B2 * | 6/2014 | Rydinsky | D06F 59/02 211/86.01 |
| D766,531 | S | 9/2016 | Verdoia et al. | |
| 9,856,597 | B2 * | 1/2018 | Smoots | D06F 59/04 |
| 2010/0282456 | A1 * | 11/2010 | Benignos | F28F 1/30 165/182 |
| 2018/0105972 | A1 * | 4/2018 | Smoots | F26B 21/008 |

OTHER PUBLICATIONS

Rack Em Racks Economy Boot & Glove Dryer: www.amazon.com/RACK-EM-Racks-Economy-Glove/dp/B00GY7X0KA; Accessed Oct. 16, 2018.

Ready Rack Glove Dry Hanger: https://store.danko.net/Ready-Rack-Glove-Dry_Hanger-GRRDH.html; Accessed Oct. 16, 2018; Accessed Oct. 16, 2018.

Tadgreen Multipurpose Drying Rack; www.kmart.com/tadgreen-multi-purpose-drying-rack-sports-water/p-SPM9153121202; Accessed Oct. 16, 2018.

Household Essentials 1-Tier 9 Pair Shoe Rack: www.wayfair.com/storage-organization/pd/household-essentials-1-tier-9-pair-shoe-rack-huu2503.html; Accessed Oct. 16, 2018.

* cited by examiner

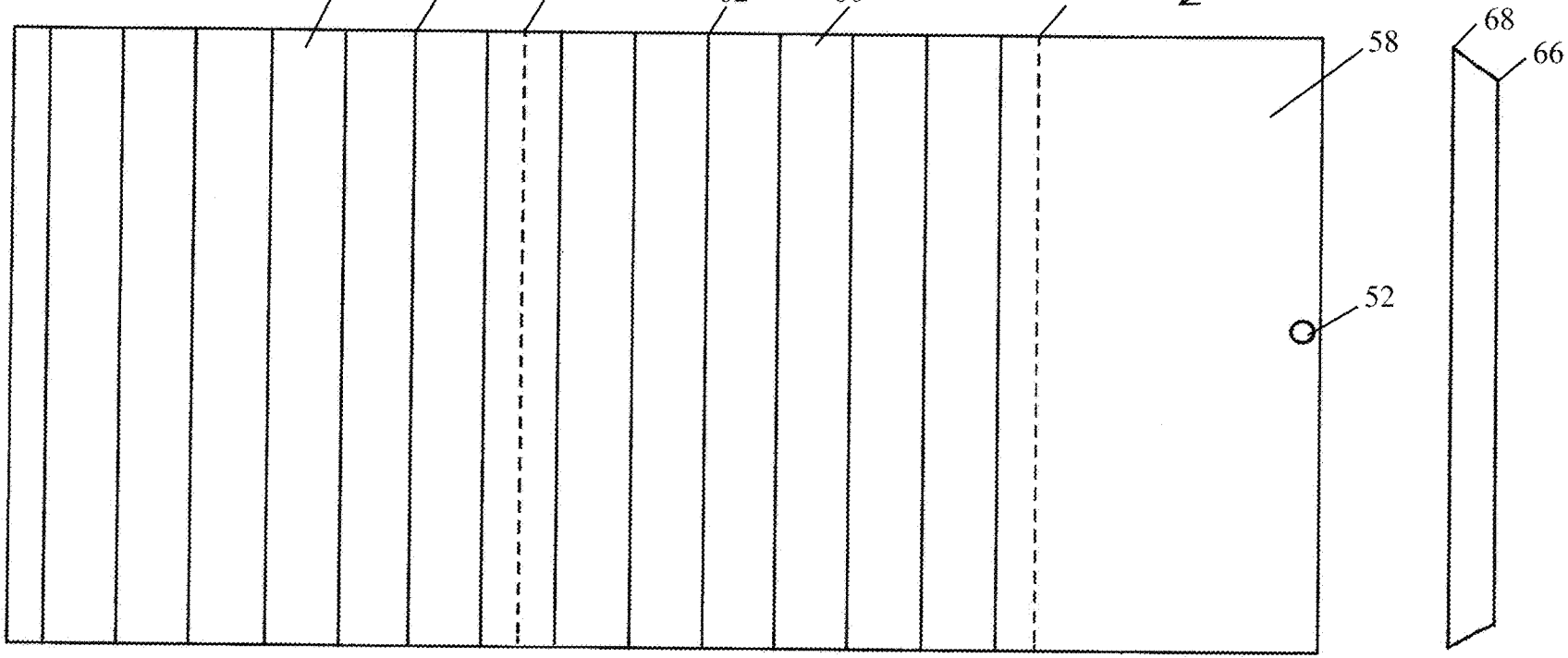
Fig. 5A
Fig. 5C
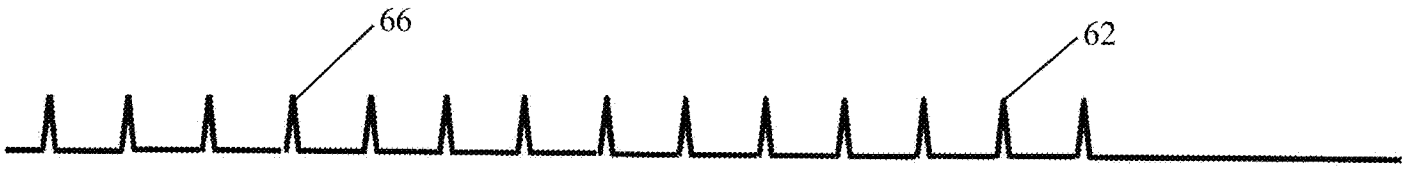
Fig. 5B

AERATOR

PRIORITY/CROSS-REFERENCE TO RELATED APPLICATIONS

This application claims the benefit of U.S. Provisional Application No. 62/570,711, filed Oct. 11, 2017, the disclosure of which is incorporated by reference.

TECHNICAL FIELD

The disclosure generally relates to the field of aerating or drying clothing. Particular embodiments relate to a new and improved apparatus for aerating gloves wherein the invention can be easily assembled and disassembled for portability and may be used in conjunction with outside forced-air drying devices.

BACKGROUND

People utilize a variety of clothing articles in cool or cold weather to keep their bodies warm, including their hands and feet. For example, gloves are used for many occasions and to be effective, hand gloves must remain dry on the inside. While wearing gloves in cold or wet conditions, the inside of the gloves can retain moisture. Additionally, when wearing gloves in hot temperatures or while working outside, the perspiration from one's hand can also lead to moisture collection in the inside of the glove.

The general purpose of wearing gloves is to provide insulation to maintain warmth in a user's hands in cold and/or wet weather. If the inside of a glove becomes saturated with moisture, the glove cannot adequately serve this purpose. Most gloves will not keep the hand properly warm if the glove is wet. When a person is outside in cold temperatures for an extended period of time, it is almost inevitable that at some point, the inside of the glove, mitten, sock, or other clothing article will become saturated with moisture.

When the inside of the glove becomes saturated with moisture, the glove must be dried. Traditional methods of drying wet gloves involve airing the glove out. This usually takes time and the glove remains damp until a sufficient amount of time is provided for the glove to dry. This is because gloves lay flat when hands are not inside and because the gloves lay flat, air circulation is minimal.

Prior devices have tried to address this issue by developing an apparatus that uses a motor and heat to dry the inside of the glove. The problem with devices that use motors and heaters is they are not portable and require electricity. Often when one wants to dry his/her gloves, he/she is camping, hiking, traveling, or working out in the elements. Under these conditions, it is impractical to lug around a cumbersome glove drying device. Often individuals are away from electricity and unable to power such a device. The aerator provides a solution to these problems.

SUMMARY OF THE DISCLOSURE

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

Accordingly, what is disclosed is a device for aerating gloves or other clothing items that has a duct, the duct having a first opening on a first end and a second opening on a second end, a longitudinal axis and a transverse axis, with the longitudinal axis longer than the transverse axis. The duct is gas permeable, and can be cylindrical or non-cylindrical, with projections that extend outwards to create air channels protruding from the duct, and creating a stand-off space around the outer surface. The longitudinal axis provides for the circulation. The aerator duct is formed from flat stock and is portable. It is made using a thermoform, thermoforming or vacuum form process. The aerator can have projections that are V-folds and may be powered by convection. It may also be configured for horizontal use. The term "glove" or "gloves" as used herein is not meant to limit the device only to gloves, but instead for use for drying any of a variety of clothing or footwear that a user may need to dry. These alternative clothing articles can include mittens or other clothing, such as socks, with which the inventive concepts herein may be used.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

BRIEF DESCRIPTION OF THE DRAWINGS

FIG. 5A is a top view of an embodiment of the invention in a flat sheet form in which two aerators are shown from a single flat stock.

FIG. 5B is a side view of an embodiment of the invention shown in 5A.

FIG. 5C is a second side view of an embodiment of the invention shown in 5A.

DETAILED DESCRIPTION OF THE PREFERRED EMBODIMENTS

Figure 1A:
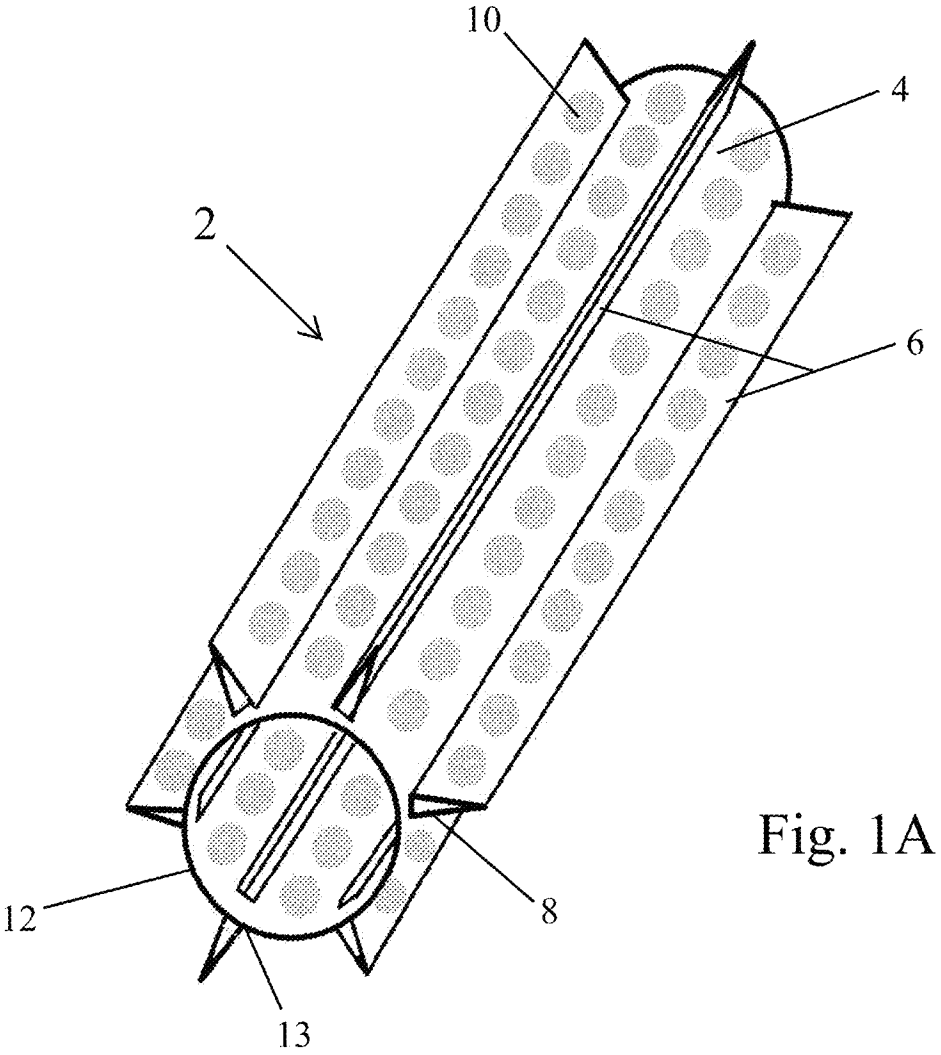
FIG. 1A is a perspective view of a first embodiment of the invention.

FIG. 1A illustrates a preferred embodiment of the invention. FIG. 1A depicts an aerator useful for drying, for example a boot, shoe, glove, or mitten. The aerator 2 depicted in FIG. 1A includes a cylindrical base section 4. The cylindrical base section is configured for air to travel through the cylindrical base section. The air travel can either be a forced air system, such as an attachment to a device having a blower, or can be a passive system. In a passive system the aerator is utilized to hold open an object to allow for air circulation and drying. The device has a series of projections emanating 10 that protrude from the outer surface 4 of the cylinder. In the depicted embodiment the projections are a triangular shape 8 having a wider base and a narrower apex. However, a variety of projections shape could be utilized. The cylinder as well as the projections can have openings 10 to facilitate the flow of air. In the depicted embodiment of FIG. 1 the projections 13 are attached to the surface 12 of the cylindrical base.

Figure 1B:
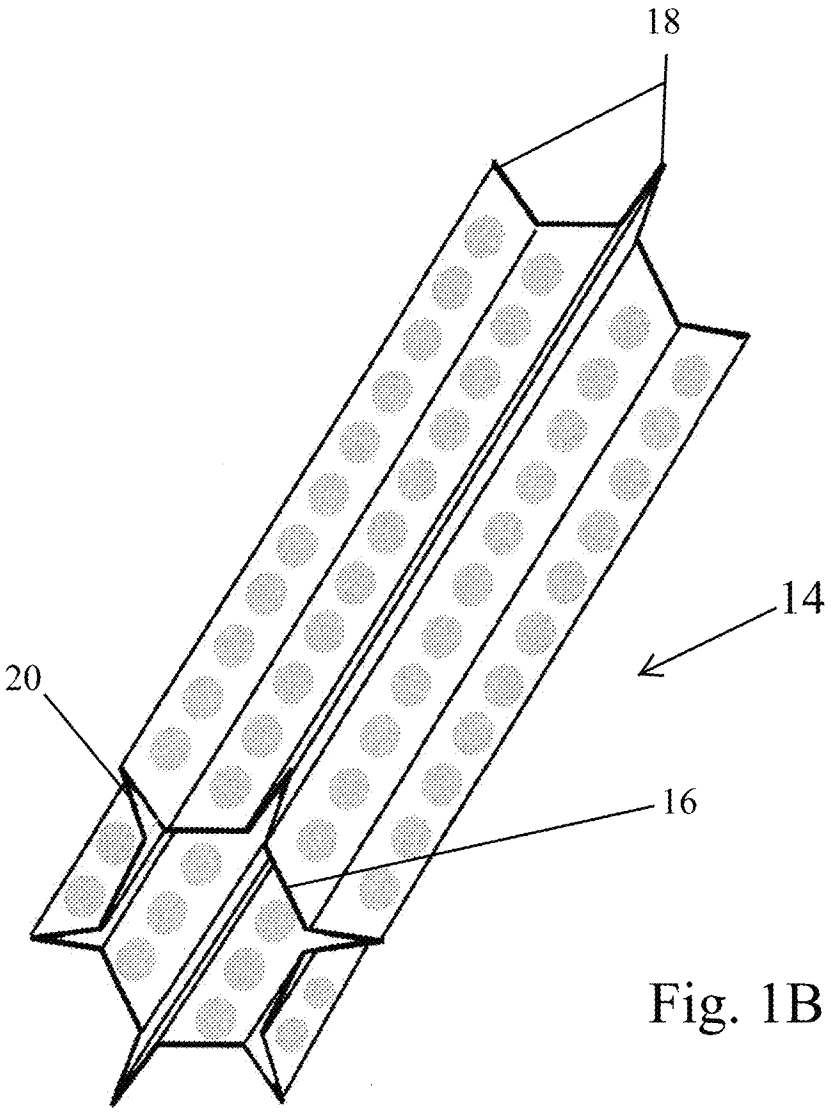
FIG. 1B is a perspective view of an embodiment of the invention.

FIG. 1B illustrates a second preferred embodiment of the invention. In the depicted embodiment the projections of FIG. 1A are shown as an integral part of the aerator. The projections are folds in the structure of the aerator. The aerator has a general circular depiction, or in the depicted embodiment a hexagonal depiction with the projections emanating from each corner of the hexagon. The hexagonal shape depicted in FIG. 1B can be configured in a variety of shapes. The aerator 14 utilizes a series of openings in the projections, as well as in the base section to allow for the circulation of air. The projections 18 emanate from the base section 16 so as to form a division between each base section 16 and a neighboring base section. The projection is preferably hollow 20 either depicted in FIG. 1A or FIG. 1B to allow for the flow of air. In the embodiment of FIG. 1A the projections are preferably created by folds in the material. These folds are pre-molded into the invention and run the length of the longitudinal axis of the aerator. In the depicted embodiment the aerator can be utilized with two gloves, socks, or other clothing article with one of each being placed over each end of the aerator. For example, a glove will be placed around the first opening of the aerator and another glove will be placed around the second opening of the aerator. As shown, the aerator has projections that are formed through bends in the material. These projections allow for air flow, circulation, and convection. While gloves are attached to the aerator, the projections will allow the gloves to be open as opposed to lying flat. This will easily allow wet gloves to dry faster.

In other embodiments of the aerator, the aerator has interlocking tabs that connect. The interlocking tabs can be male and female and join to hold the aerator together. The aerator is assembled by attaching these projections. The end edge projection of the first end lies inside of the end edge projection of the second end. This creates an apparatus that is easily assembled and disassembled, adding to the portability of the invention.

Figure 2A:
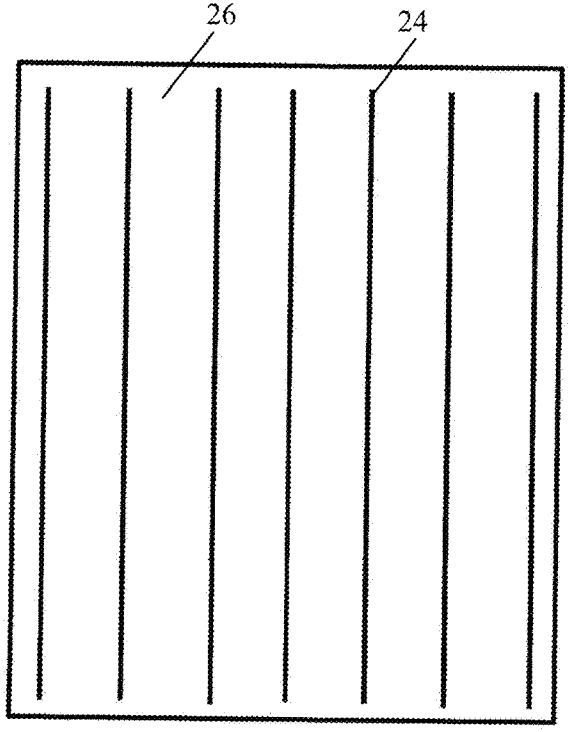
FIG. 2A is a top view of an embodiment of the invention in a flat or unrolled position.
Figure 2B:
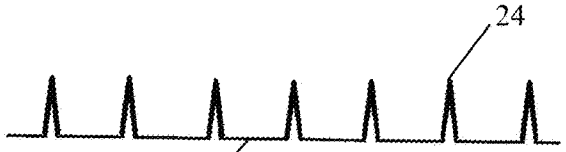
FIG. 2B is a side view of an embodiment of the invention shown in 2A.
Figure 2C:
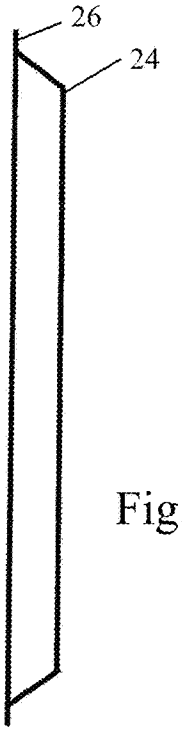
FIG. 2C is a second side view of an embodiment of the invention shown in 2A.

FIG. 2A depicts a preferred embodiment of the invention shown in FIG. 1B prior to being folded into the configuration shown in FIG. 1B. In a preferred embodiment, the aerator is manufactured as a single piece. This piece 22 has a flat base 26 and projections 24 protruding upward from the flat base. The device is then bent into a circle with one projection capable of being placed on another projection to hold to the device in a circular form. This will allow the device to be manufactured in an inexpensive material such as a plastic. In a preferred embodiment the device will utilize openings throughout the projections and/or base for the flow of air.

Figure 3C:
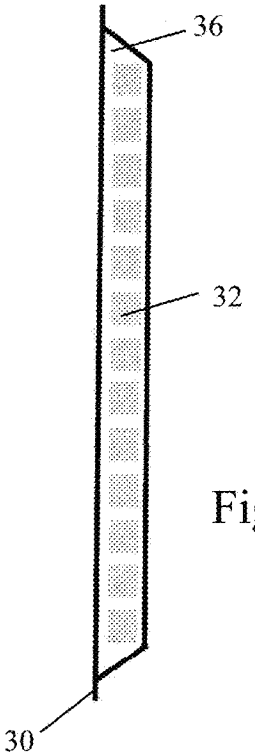
FIG. 3C is a second side view of an embodiment of the invention shown in 3A.
Figure 3A:
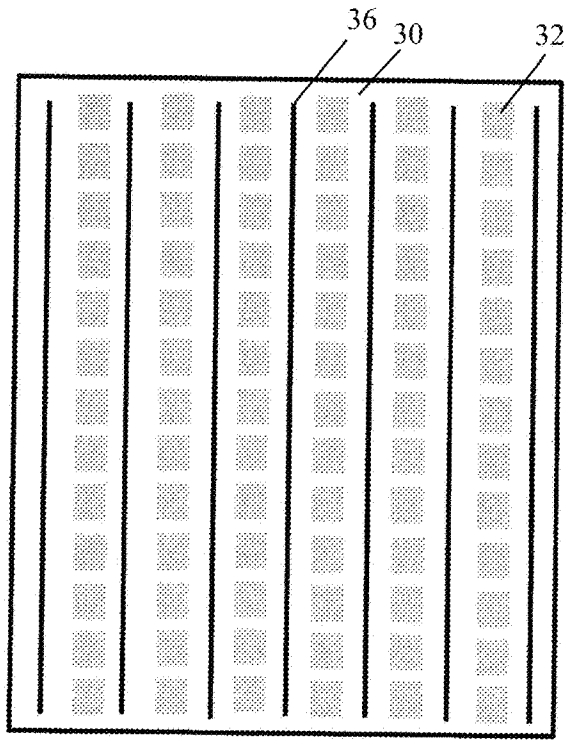
FIG. 3A is a top view of an embodiment of the invention in a flat or unrolled position.

FIG. 3A illustrates a preferred embodiment of the invention of FIG. 2A shown utilizing openings 32 in the base section 30 of the flat piece 28. Projections 36 can also utilize openings 33.

Figure 3B:
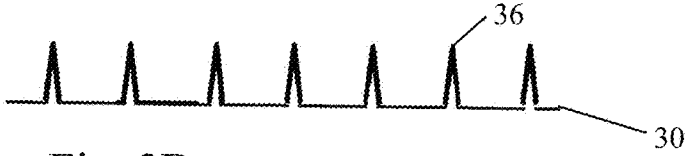
FIG. 3B is a side view of an embodiment of the invention shown in 3A.

FIG. 3B illustrates a side view from the top of the sheet, whereas FIG. 3C illustrates a side view from the side of the sheet showing projections 36 emanating outward from flat section 30. The openings in FIGS. 3A, 3B, and 3C are square rectangles; alternatively a round or rectangular opening could be used in addition to a variety of shapes.

Figure 4A:
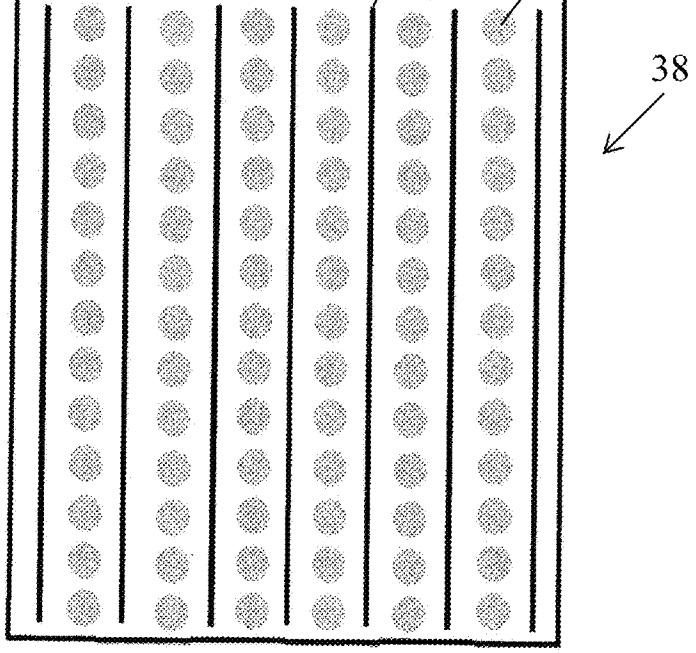
FIG. 4A is a top view of an embodiment of the invention in a flat or unrolled position.
Figure 4B:
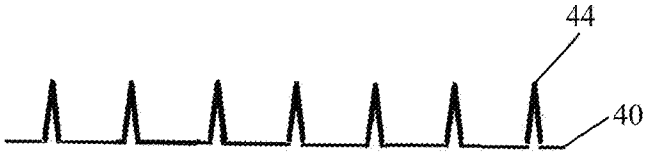
FIG. 4B is a side view of an embodiment of the invention shown in 4A.
Figure 4C:
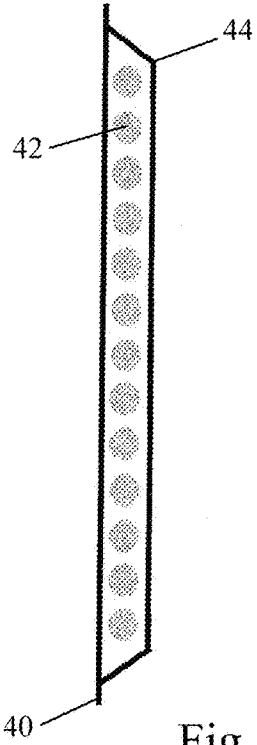
FIG. 4C is a second side view of an embodiment of the invention shown in 4A.

FIGS. 4A, 4B, and 4C illustrate in an alternative embodiment of the invention shown in 2A and 3A. FIG. 4A depicts a flat section 40 having openings 42 and protrusions 48. The flat section 38 can then be rolled into a cylindrical section. In the depicted embodiment the device has openings on both the flat section 40 as well as the projection 44, as illustrated by opening 43. Alternatively the depicted embodiment can utilize no openings, or openings on one or the other of the flat section base 40 or projection 44.

FIGS. 5A, 5B, and 5C illustrate a preferred embodiment of the invention in which two of the aerators are manufactured on a single sheet along with a hangtag. A flat section of the device 50 is manufactured with a hangtag section 58 that has an opening 52 to be able to be placed on a hook or similar for display at a sales venue. A perforation 56 separates the hangtag section from a first section 60 of a first aerator portion. A second perforation 64 separates the first aerator section from a second aerator section 68. Each aerator has a base as well as projections. FIG. 5B illustrates a cross-sectional view of FIG. 5A. FIG. 5C illustrates a view from the left side of FIG. 5A. Each of the separate aerators can be detached at the perforations and then rolled into the aerator depicted in FIG. 1B and subsequently utilized by a user.

Figures 6A, 6B, 6C:
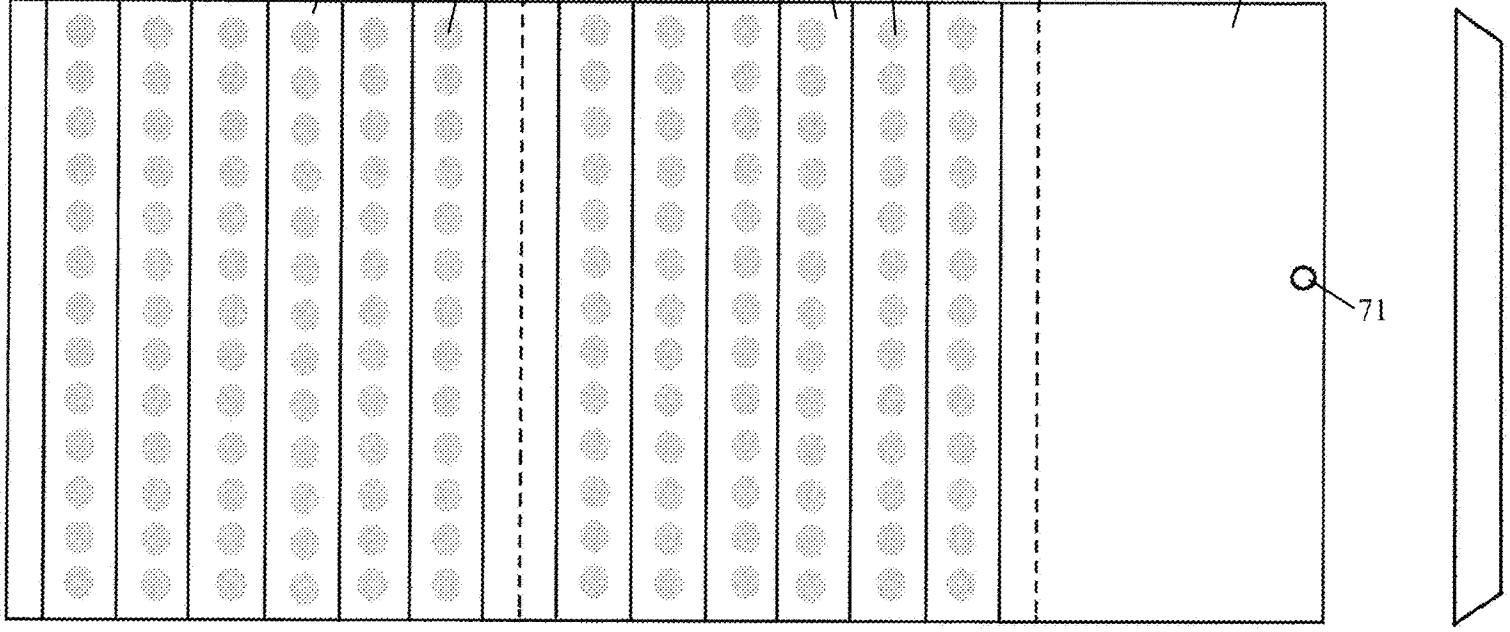
FIG. 6A is a top view of an embodiment of the invention in a flat sheet form in which two aerators are shown from a single flat stock.
FIG. 6B is a side view of an embodiment of the invention shown in 6A.
FIG. 6C is a second side view of an embodiment of the invention shown in 6A.

FIG. 6A illustrates an alternative embodiment of the invention shown in FIGS. 4A, B, and C. The embodiment shown in 6A, 6B, and 6C show a general flat section 70 having a hangtag portion 72 and an opening for a hook 71. The hangtag section is separated from a first aerator section by a perforation 73. The aerator section utilizes a base section 74 having projection 78. Openings can be provided on the flat section 74. The first aerator section is separated from the second aerator section 82 by perforation 80. The second aerator section utilizes projections 84 extending upward from the flat section. The flat section utilizes circular openings 86. FIG. 6B illustrates a side view taken from a base of the invention. FIG. 6C illustrates a side view of the invention.

Figures 7A, 7B, 7C:
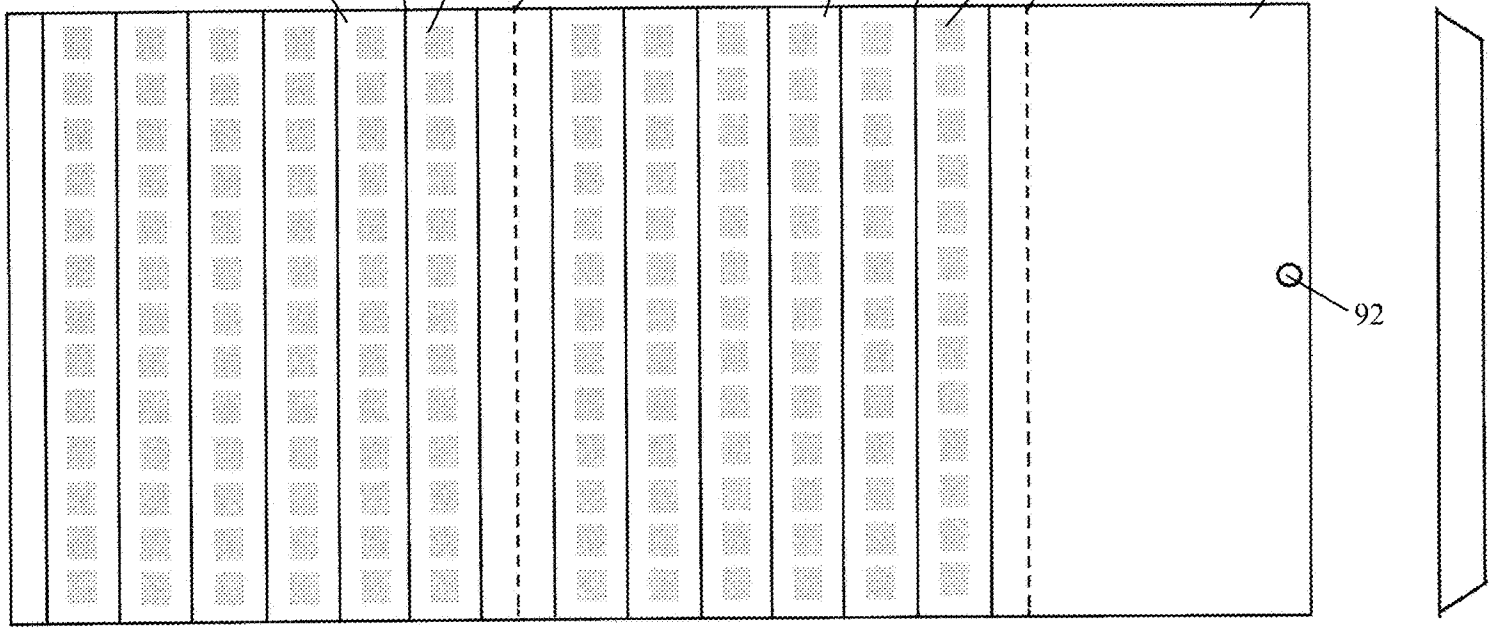
FIG. 7A is a top view of an embodiment of the invention in a flat sheet form in which two aerators are shown from a single flat stock.
FIG. 7B is a side view of an embodiment of the invention shown in 7A.
FIG. 7C is a second side view of an embodiment of the invention shown in 7A.

FIG. 7A illustrates an alternative embodiment 90 of the invention. The alternative embodiment utilizes similar hangtag 94 having an opening for a hook 92. The hangtag section is separated from a first aerator section 98 by a perforation 96. The first aerator section utilizes projections 100 extending upward from the base of the aerator. The base of the aerator uses square openings 102 to enhance air flow. The first aerator section is separated from a second aerator section 110 by a perforation 104. This second aerator section utilizes projections 108 and openings 106 in the base of the second aerator. FIG. 7B illustrates a cross-sectional or side view from the base of FIG. 7A. FIG. 7C illustrates a side view of a projection extending upward from the base area.

To assemble the aerator, the flat sheet is rolled in a cylindrical fashion, forming a duct or a tube. The duct is then attached by taking the first projection of the first end and seating it inside the last projection of the second end and connecting the interlocking tabs. The projections create a method of fastening the aerator to itself. The aerator is then ready to be used to dry one or more gloves. Once a glove is positioned on the aerator, the aerator can then be laid horizontally or propped up vertically.

The aerator can be made from various materials including but not limited to one of the following: acrylonitrile butadiene styrene, polyethylene terephthalate glycol, polycarbonate, styrene, or any thermo-forming material, vacuum forming material not listed. These materials provide for the durability while at the same time providing for lightweight flexibility.

The aerator can be configured for multiple cutouts that run the length of the non-projection channels. These cutouts allow for further airflow and enhanced circulation to guarantee faster drying times. These cutouts are optional and can be round, oblong, or any shape. The cutouts are numerous and run the entire length of the longitudinal axis of the aerator.

The thickness of the aerator can vary; however the usual range is between 0.020 inches to 0.1 inches thick. The manufacturing process involves thermoform, thermoforming or vacuum form.

When the user has finished using the aerator or when the gloves are dry, the gloves are removed and are ready to be worn again. The aerator can then be disassembled and flattened out again for storage and transportation. The aerator can be configured to allow gloves to be dried using only convection. To speed the drying of garments even further, the aerator can be placed on top of a vent that blows air, preferably hot air, such as a heating/cooling vent in one's home or car, or a vent on a forced-air glove and/or boot dryer. Though this feature is purely optional, it adds another benefit to the aerator.

Unlike some other glove or boot dryers comprising a motor, fan, blower, and possibly a heater, the present invention does not require an outside heating element or blowing element. The additional heating or blowing elements in the prior art come with limitations and problems. The present invention is small, portable, simple to use, and failsafe whereas other dryers can be large and difficult to operate, require a power source, and have the possibility of mechanical failure.

While certain preferred embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

The invention claimed is:

1. A aerator which comprises:

a duct, said duct having a first opening on a first end and a second opening on a second end and comprising a length between said first end and said second end, wherein said duct defining a longitudinal axis and a transverse axis, with said longitudinal axis longer than said transverse axis, said duct comprising an inner surface and outer surface, wherein said duct is constructed of plastic, wherein said duct is formed from a flat stock;

a plurality of projections that extend outwards and create a plurality of air channels protruding from said duct, creating a standoff space around the outer surface, wherein said projections are V-folds in said flat stock, wherein a V-fold at a first end of said flat stock and a V-fold at a second end of said flat stock are configured to releasably attach to form said duct;

a longitudinal axis providing for the circulation.

2. The aerator of claim 1, in which the duct is portable.

3. The aerator of claim 1, in which said aerator is powered by convection.

4. The aerator of claim 3, in which said aerator is configured for horizontal use.

5. The aerator of claim 1, wherein said duct comprises a cylindrical shape.

6. The aerator of claim 1, wherein said projections are hollow.

7. The aerator of claim 1, wherein said projections comprise an opening in a face of said projection for facilitating airflow.

8. The aerator of claim 1, wherein said first end is closed.

9. The aerator of claim 1, wherein said aerator is configured for attachment to a forced air glove dryer.

10. The aerator of claim 1, wherein said duct further comprises openings along said length of said duct, wherein said openings are configured for airflow.

11. The aerator of claim 1, wherein said flat stock is configured to be hung on a hook.

12. The aerator of claim 1, wherein said aerator further comprises a first aerator and a second aerator, wherein said first and second aerators are formed from a piece of flat stock and configured to be separated along a perforation separating said first aerator and said second aerator in said flat stock.

* * * * *